US010654497B2

(12) United States Patent
Vosahlo

(10) Patent No.: US 10,654,497 B2
(45) Date of Patent: May 19, 2020

(54) RAILCAR TOWING SYSTEMS AND RAILCAR TOWING METHODS USING THE SAME

(71) Applicant: BNSF Railway Company, Fort Worth, TX (US)

(72) Inventor: Sean Vosahlo, Moorcroft, WY (US)

(73) Assignee: BNSF Railway Company, Fort Worth, TX (US)

( * ) Notice: Subject to any disclaimer, the term of this patent is extended or adjusted under 35 U.S.C. 154(b) by 449 days.

(21) Appl. No.: 15/692,460

(22) Filed: Aug. 31, 2017

(65) Prior Publication Data

US 2018/0057024 A1 Mar. 1, 2018

Related U.S. Application Data

(60) Provisional application No. 62/382,465, filed on Sep. 1, 2016.

(51) Int. Cl.

| | |
|---|---|
| ***B61G 5/02*** | (2006.01) |
| ***B61G 1/04*** | (2006.01) |
| ***B61F 99/00*** | (2006.01) |
| ***B61G 5/00*** | (2006.01) |
| ***B61F 1/14*** | (2006.01) |
| ***B61F 1/10*** | (2006.01) |

(52) U.S. Cl.

CPC ..... *B61G 5/02* (2013.01); *B61F 99/00* (2013.01); *B61G 1/04* (2013.01); *B61G 5/00* (2013.01); *B61F 1/10* (2013.01); *B61F 1/14* (2013.01)

(58) Field of Classification Search

CPC .... B61G 5/00; B61G 5/02; B61G 1/04; B61F 99/00

USPC ..... 213/78

See application file for complete search history.

(56) References Cited

U.S. PATENT DOCUMENTS

| | | | | | |
|---|---|---|---|---|---|
| 789,467 | A * | 5/1905 | West | B65H 69/04 | 289/3 |
| 1,597,383 | A * | 8/1926 | Morton | B60D 1/182 | 267/73 |
| 2,407,634 | A * | 9/1946 | Du Pont | B64D 3/00 | 244/3 |
| 2,652,219 | A * | 9/1953 | Arthur | B65D 19/0095 | 108/57.14 |
| 2,747,890 | A * | 5/1956 | Gerhardt | B62D 53/068 | 280/406.1 |
| 3,525,989 | A * | 8/1970 | Fagan | B63B 32/70 | 340/286.13 |
| 4,345,523 | A * | 8/1982 | Robertson | B61G 5/02 | 105/1.4 |
| 4,442,709 | A * | 4/1984 | Waters | B61G 5/00 | 105/101 |
| 4,454,953 | A * | 6/1984 | Chierici | B61G 1/04 | 213/162 |
| 4,794,867 | A * | 1/1989 | Titz | B60D 1/40 | 105/3 |

(Continued)

*Primary Examiner* — Jason C Smith

(57) ABSTRACT

A block, towing system, and a method for towing rail cars is provided. The block includes a first channel, a second channel, a third channel and a fourth channel. The first channel is located on a first side of the block. The second channel is located adjacent to the first channel on the first side of the block. The third channel is located on an opposite side of the block from the first channel. The fourth channel is located adjacent to the third channel on the opposite side of the block from the second channel.

13 Claims, 5 Drawing Sheets

(56) References Cited

U.S. PATENT DOCUMENTS

| | | | | | |
|---|---|---|---|---|---|
| 5,000,097 | A * | 3/1991 | List | B61D 3/10 | 105/167 |
| 5,174,218 | A * | 12/1992 | List | B61D 3/10 | 105/167 |
| 5,741,280 | A * | 4/1998 | Fleenor | A61B 17/0469 | 112/169 |
| 2014/0199859 | A1 * | 7/2014 | Jordan | B60Q 1/24 | 439/34 |
| 2018/0057024 | A1 * | 3/2018 | Vosahlo | B61G 5/02 | |
| 2019/0100224 | A1 * | 4/2019 | Cox | B61G 5/00 | |

* cited by examiner

RAILCAR TOWING SYSTEMS AND RAILCAR TOWING METHODS USING THE SAME

CROSS-REFERENCE TO RELATED APPLICATION(S) AND CLAIM OF PRIORITY

This application claims priority under 35 U.S.C. § 119(e) to U.S. Provisional Patent Application No. 62/382,465 filed on Sep. 1, 2016 titled "RAILCAR TOWING SYSTEMS AND RAILCAR TOWING METHODS USING THE SAME." The above-identified provisional patent application is hereby incorporated by reference in its entirety.

TECHNICAL FIELD

The present disclosure relates generally to railroad operations. More particularly, the present disclosure relates to railcar towing systems and railcar towing methods using the same.

BACKGROUND

In railroading, a drawbar and coupler at the end of each railcar couple with an opposing coupler and drawbar of a longitudinally adjacent railcar to form a train. If the drawbar or coupler on a railcar is damaged or nonfunctional, some means is required to maintain the connection between the railcars such that the disabled railcar can be towed to a siding. Current techniques involve a tow strap and ratchet system, which is unreliable because of the frequency with which the strap and/or ratchet break.

Other solutions for towing a disabled railcar have also proven burdensome and unreliable. For example, a combination of tow ropes and boundary hooks is sometimes utilized, but boundary hooks are heavy and therefore challenging to couple onto a railcar for towing. Accordingly, it would be advantageous to have systems and methods that take into account one or more of the issues discussed above, as well as possibly other issues.

SUMMARY

Embodiments of the present disclosure provide an apparatus, advice, and method for towing railcars.

In one example embodiment, a block is provided. The block includes a first channel, a second channel, a third channel and a fourth channel. The first channel is located on a first side of the block. The second channel is located adjacent to the first channel on the first side of the block. The third channel is located on an opposite side of the block from the first channel. The fourth channel is located adjacent to the third channel on the opposite side of the block from the second channel.

In another example embodiment, a method is provided. The method involves threading a first end of a tow rope through a first channel located on a first side of a block. The method further includes threading the first end of the tow rope through a second channel forming a first loop in the tow rope, the first loop extending outward from the first channel and the second channels on a front side of the block, where the second channel is located adjacent to the first channel on the first side of the block. The method also includes extending the first end out of the second channel on a back side of the block. The method continues by threading a second end of the tow rope through a third channel located on an opposite side of the block from the first channel; and threading the second end of the tow rope through a fourth channel forming a second loop in the tow rope, the second loop extending outward from the third and fourth channels on the back side of the block, wherein the fourth channel is located adjacent to the third channel on the opposite side of the b lock from the second channel. The method also includes extending the second end out of the second channel on the front side of the block.

In another example embodiment, a system is provided. The system includes a tow rope and a block. The block includes a first channel, a second channel, a third channel and a fourth channel. The first channel is located on a first side of the block. The second channel is located adjacent to the first channel on the first side of the block. The third channel is located on an opposite side of the block from the first channel. The fourth channel is located adjacent to the third channel on the opposite side of the block from the second channel.

Other technical features may be readily apparent to one skilled in the art from the following figures, descriptions, and claims.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 5, discussed below, and the various embodiments used to describe the principles of the present disclosure in this patent document are by way of illustration only and should not be construed in any way to limit the scope of the present disclosure. Those skilled in the art will understand that the principles of the present disclosure may be implemented in any type of suitably-arranged device or system.

Modern railroading at times requires towing disabled railcars to a siding. Current techniques using a strap to secure and pull railcars require complicated strap and ratchet mechanisms, which are difficult to apply in the field. In this way, a railcar is coupled to a disabled railcar via the tow strap. Once the two railcars are coupled using the strap, the ratchet is used to tighten the tow strap. Once the tow strap is sufficiently tightened, the non-disabled railcar is able to safely tow the disabled railcar to a siding. Once the disabled railcar is safely located at a siding, the ratchet is released and the tow straps are removed. Unfortunately, this method is unreliable because the tow straps and the ratchet used to tighten the tow straps break frequently.

Another method of towing disabled railcars involves the use of a tow rope and boundary hooks, which each hook couples to a slot at the end of a side frame of adjacent railcars. This method is difficult for a user to implement in the field because of the weight of the boundary hooks. Further, each railcar requires a separate boundary hook. Attaching this towing system requires a railcar worker to move four heavy hooks, two on each side of each railcar, and attach the tow rope to each, before the disabled railcar may be towed. The lack of reliable towing methods is problematic because of the importance of towing disabled railcars off the tracks quickly and efficiently. Because railroads can be used by many trains in a single day, a disabled railcar on a track has the potential to delay multiple trains.

Figure 1:
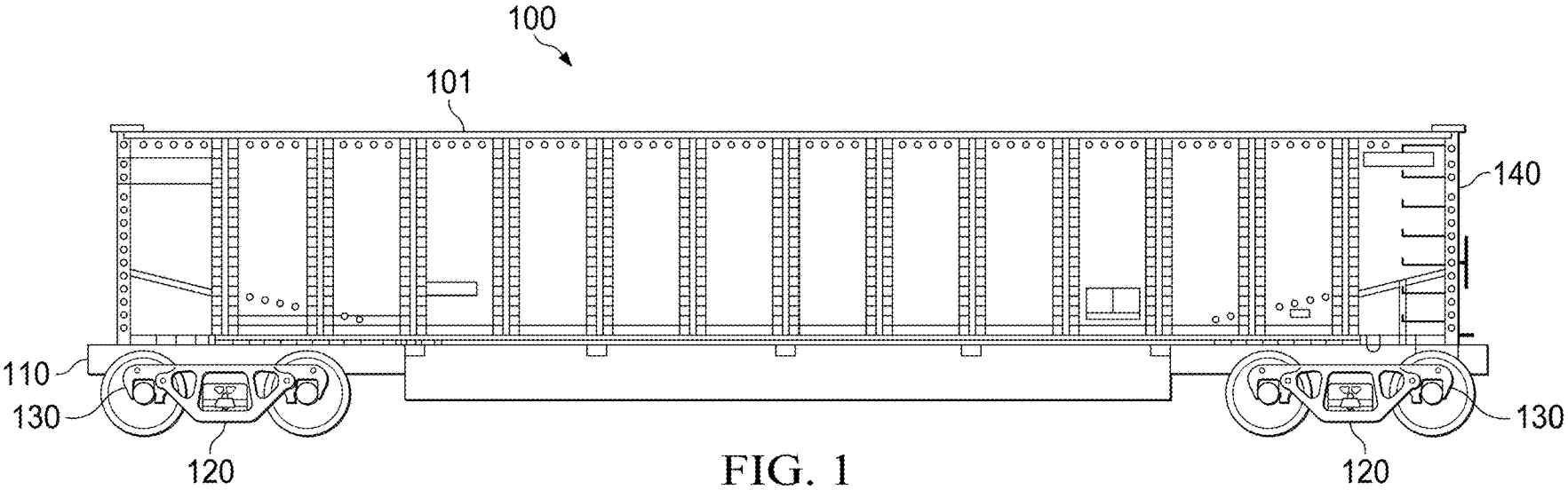
FIG. 1 illustrates a railcar in accordance with various embodiments of the present disclosure.

FIG. 1 illustrates a side view of a railcar 100 in accordance with various embodiments of the present disclosure. While a gondola railcar is shown in FIG. 1, the principles of the present disclosure are equally applicable to other types of railcars. The embodiment of railcar 100 shown in FIG. 1 is for illustration only. Other embodiments of the railcar 100 could be used without departing from the scope of this disclosure.

The railcar 100 includes an elongated receptacle 101, a base section 110, the pair of car trucks 120, and a side frame 130. Various embodiments also include an upper section 140. The railcar 100 may be any type of railroad car suitable for traveling along a railroad. For example, the railcar 100 may be any one of a passenger car, freight car, or any other type of railcar known to one of ordinary skill in the art.

The elongated receptacle 101 is supported on a pair of conventional railroad car trucks 120. The receptacle 101 is adapted to receive bulk materials, for example coal. The base section 110 may be of any suitable dimensions, but in a certain embodiment is configured and spaced according to standard railroad specifications for a railcar 100. In some embodiments, the base section 110 is coupled to the upper section 140. In other embodiments, the base section 110 and the upper section 140 may be a single element that cannot be separated. In various embodiments, the upper section 140 may be a shipping container, a passenger car, or any other suitable upper section of a railcar known to one of ordinary skill in the art.

Figure 2:
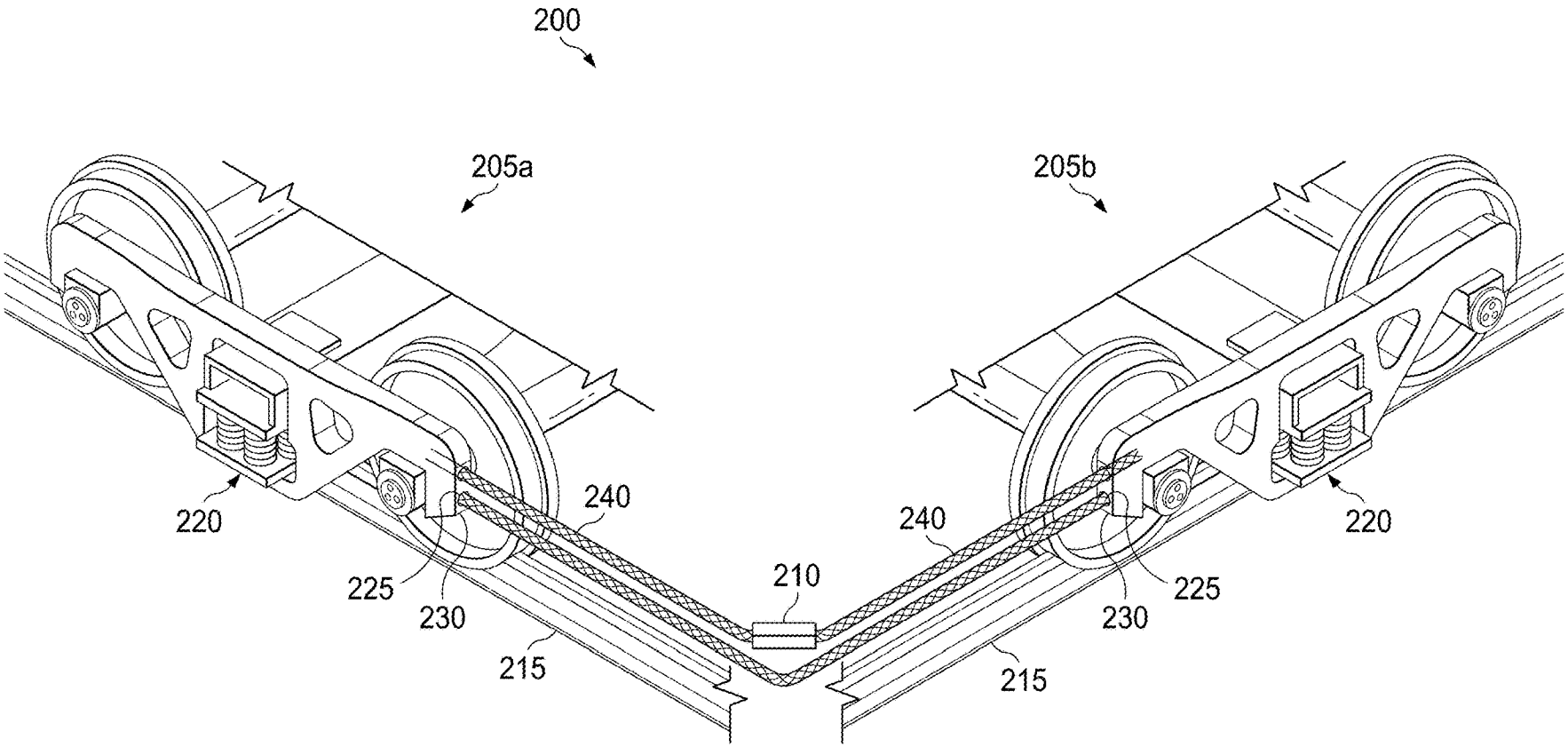
FIG. 2 illustrates a railcar towing system in accordance with various embodiments of the present disclosure.

The car trucks 120 are coupled to the base section 110 and provide the railcar's 100 connection to the railroad track 215 (illustrated in FIG. 2). The car trucks 120 are comprised of wheels, which guide the railcar along the railroad track, the side frame 130, and one or more axles coupled to the wheel. Any suitable pair of car trucks 120 known to one of ordinary skill in the art may be utilized in the railcar 100.

The side frame 130 couples to the axle of the car truck 120, and serves as the axle's connection to the base section 110 of the railcar 100. Further, a pair of slots 225 (illustrated in FIG. 2) is included at each end of the side frame 130. The slots 225 in the side frame 130 may be of any diameter equal to or greater than the diameter of a standard tow rope 240. In various embodiments, the tow rope 240 has a diameter of approximately 0.5 inches. In various embodiments, the tow rope 240 has a diameter of up to 0.75 inches. The tow rope 240 is discussed in greater detail below. In certain embodiments, the slots 225 in the side frame 130 serves as the attachment point for the tow rope 240 when the railcar 100 is disabled and being towed or serving as the tow car which tows a disabled car.

Although FIG. 1 illustrates one example of a railcar 100, various changes may be made to FIG. 1. For example, the components of the railcar 100 are for illustration only. Various components in FIG. 1 could be omitted, combined, or further subdivided and additional components could be added according to particular needs.

FIG. 2 illustrates a railcar towing system 200 in accordance with various embodiments of the present disclosure. The embodiment of the railcar towing system 200 shown in FIG. 2 is for illustration only. Other embodiments of the railcar towing system 200 could be used without departing from the scope of this disclosure.

The railcar towing system 200 includes two railcars 205, two blocks 210, and two tow ropes 240. In certain embodiments, the two railcars 205 will be connected via a block 210 and a tow rope 240 on each side of the cars. However, for simplicity of description, only one side of the railcar towing system 200 is shown in FIG. 2 and described herein.

In certain embodiments, each railcar 205 includes a side frame 230 on each side of the railcar 205 and a pair of car trucks 220. In certain embodiments, each railcar 205 is a railcar 100 discussed in FIG. 1. In these embodiments, each railcar's 205 pair of car trucks 220 functions in the same way as the pair of car trucks 120 discussed in FIG. 1. However, any suitable car trucks known to one of ordinary skill in the art may be used. Also in these embodiments, each side frame 230 of the railcars 205*a* and 205*b* functions in the same way as the side frame 130 in FIG. 1. However, any suitable side frame known to one of ordinary skill in the art may be used.

The block 210 is the point of convergence where the two ends of a single tow rope 240 are joined when connecting two railcars 205 for towing. In certain embodiments, the block 210 is the block 300 described in FIGS. 3A through 3C below. In certain embodiments, two separate but identical blocks 210 are used in the system 200, one on each side of the railcars 205.

In this illustrative embodiment, a first end of the tow rope 240 is threaded through the slots 225 in the side frame 230 of railcar 205*a*. The second end of the tow rope 240 is threaded through the slots 225 in the side frame 230 of railcar 205*b*. Each end of the tow rope 240 is then threaded through channels created by the arches 320 (discussed in FIG. 3A through FIG. 3C below) of the block 210 and tied together to form a knot. The tow rope 240 may be any length necessary to connect to two railcars 205 and form a knot about the block 210.

In various embodiments, measures to protect some or all of the tow rope 240 may be taken. For example, the portions of the tow rope 240 that are inserted through the slots 225 of the side frame 230 may be covered by a protective sleeve. These portions of the tow rope 240 are subject to the most friction because these portions contact the side frame 230. Because these portions will be subject to the most friction, and therefore have a higher likelihood of fraying, these portions will derive the greatest benefit from being covered by a protective sleeve.

Once the tow rope 240 is tied onto the block 210 on one side of the railcars 205, a second tow rope 240 is connected to the railcars 205*a* and 205*b* on the opposite side. The second tow rope 240 is threaded through channels created by the arches 320 (illustrated in FIG. 3) of a second block 210 and tied to form a knot in the same manner as the first tow rope 240. This results in the two railcars 205 being joined by two tow ropes 250, one on each side. In certain embodiments, when tied the two tow ropes 250 create an identical distance between the two railcars 205. For example, if on one side the tow rope 240 is pulled taut and creates a distance of ten feet between the two railcars 205, the tow rope 240 on the other side should create a distance of ten feet between the two railcars 205 when pulled taut. If the two tow ropes 250 create different distances between the two railcars 205 when towing, the disabled railcar 205 may experience greater forces on one of the side frame 230, which could cause the railcar 205 to be derailed from the tracks.

In certain embodiments, the tow rope 240 may be marked at intervals to specify various distances from the end of the tow rope 240, such as marking 415. For example, after threading the tow rope through the channels 330 of the block, but before tying the knot, the railroad worker may want to leave at least eight inches of tail rope between the end of the tow rope 240 and the nearest channel 330 to the end. By using a tow rope 240 that is marked eight inches from the end, the railroad worker is able to consistently match the tail lengths of both ends of the tow rope 240 when tying the knot. Further, using a marked tow rope 240 avoids having to measure a specific distance every time the tow rope 240 is used, which would provide for faster connections of the two railcars 205. The tow rope 240 may be marked by any suitable manner that will not damage the tow rope 240 or prevent its use. For example, the tow rope 240 may be marked using paint, ink, tape, or any other method of marking the rope. Marking the tow rope 240 also ensures that the tensions will be even on both the first tow rope and the second tow rope connecting the railcars.

In various embodiments, the tow rope system 200 may be used with any number of types of railcars 205. Because different types of railcars 205 have different lengths, the tow rope 240 provides the advantage that it can be tied in a manner that allows the distance between the two railcars 205 to be adjusted.

Although FIG. 2 illustrates a railcar towing system 200, various changes may be made to FIG. 2. For example, the components of the railcar towing system 200 are for illustration only. Various components in FIG. 2 could be omitted, combined, or further subdivided and additional components could be added according to particular needs.

Figure 3A:
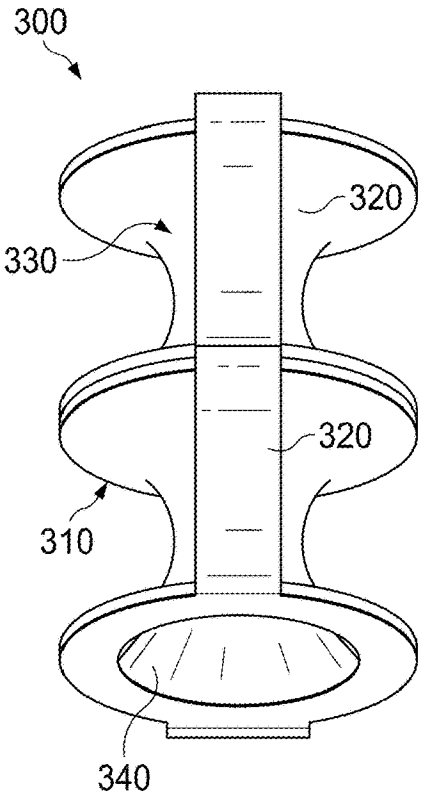
FIG. 3A illustrates a top view of a block in accordance with various embodiments of the present disclosure.
Figure 3B:
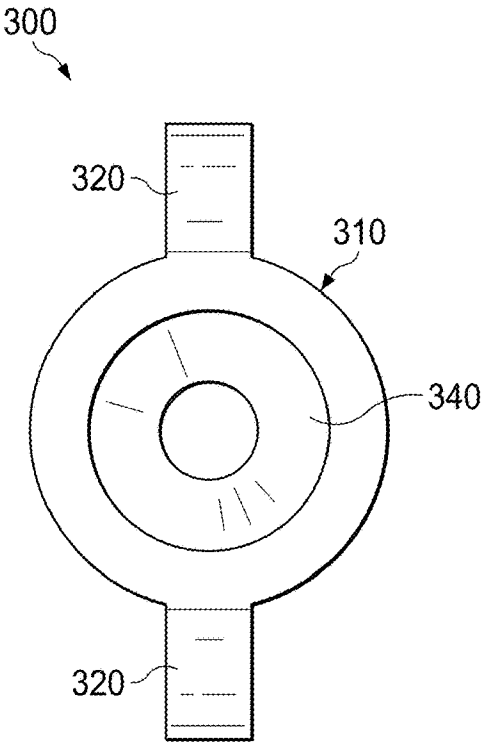
FIG. 3B illustrates a side view of a block in accordance with various embodiments of the present disclosure.
Figure 3C:
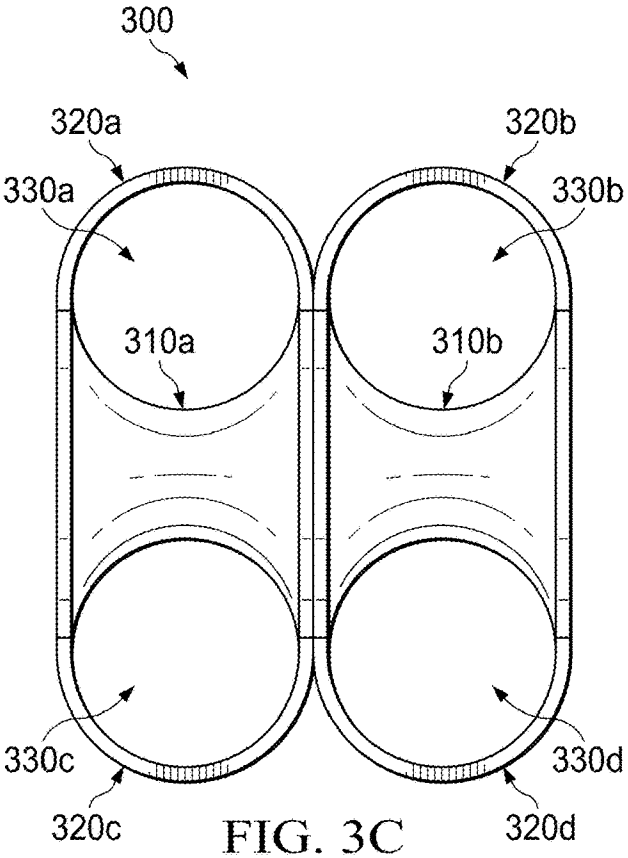
FIG. 3C illustrates a front view of a block in accordance with various embodiments of the present disclosure.
Figure 4A:
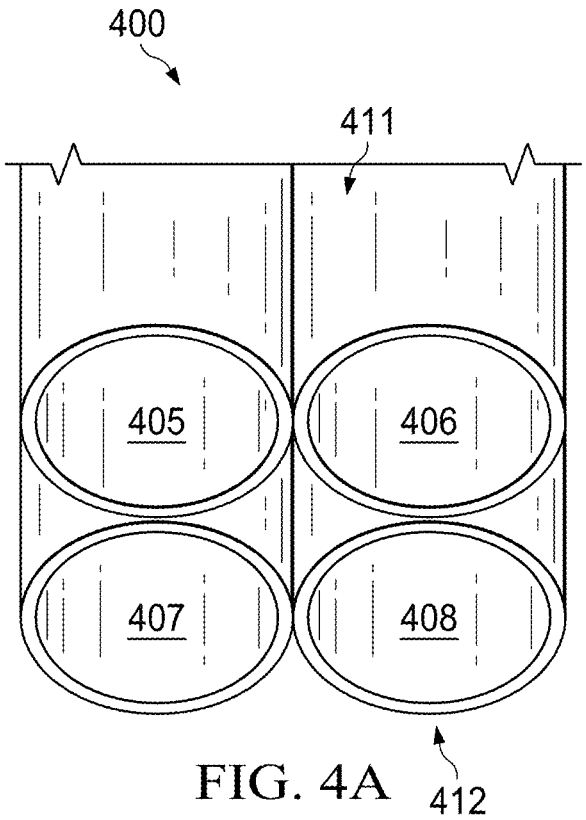
FIG. 4A illustrates a block in accordance with various embodiments of the present disclosure.

FIG. 3A illustrates a top view of a block 300 used for railcar towing in accordance with various embodiments of the present disclosure. FIG. 3B illustrates a side view of a block 300 used for railcar towing in accordance with various embodiments of the present disclosure. FIG. 3C illustrates a front view of a block 300 used for railcar towing in accordance with various embodiments of the present disclosure. The embodiments of the block 300 illustrated in FIGS. 3A-3C are for illustration only. FIGS. 3A-3C do not limit the scope of the disclosure to any particular embodiment of a rail car towing system. In certain embodiments, the block 300 is the block 210 described in FIG. 2.

In this illustrative embodiment, the block 300 includes two spools 310, four arches 320 that create four channels 330. In some embodiments, the block 300 is formed by two spools 310 coupled together by any means deemed suitable to one of ordinary skill in the art. For example, the two spools may be welded together. In other embodiments, the body is cast as a single piece embodying a pair of spools 310. The spool shape creates grooves in the block 300 through which a tow rope 240 may be threaded. The block may be comprised of steel, a magnesium alloy, osmium, or any other appropriate material.

The four arches 320 may be coupled to the spools 310 by any necessary means, for example by welding or fasteners. The space between each of the four arches 320 and the spools 310 create four channels 330, which allow the tow rope 240 to securely connect to the block 300. In some embodiments, the block 300 is cast as a single piece including the four arches 320. In certain embodiments, the four arches 320 are irremovably coupled to the spools 310. The arches 320 are configured to enclose the tow rope 240 in the four channels 330 and prevent it from sliding off of the block 300 during towing when slack in the tow ropes is created. For example, if the railcars 205 make a turn, an inside turning radius is smaller than an outside turning radius causing a tow rope on the inside radius experiencing reduced tensions and a tow rope 240 on the outside to experience greater tension. Without the four arches 320, the tow rope 240 on the inside turning radius could experience enough reduction in tension that the two rope may slip off of the groove of the spools 310. This could result in a loosening or even unraveling of the knot, causing the disabled railcar 205 to un-couple from the towing railcar 205. The arches 320 prevent this situation from unfolding by enclosing the tow rope 240 within the channels 330.

In various embodiments, the block 300 may have a hollow center 340. In these embodiments, the hollow center 340 reduces the weight of the block 300. A lighter block 300 may be advantageous because the lighter weight makes the block 300 easier to transport and implement into system 200 for railroad workers, without sacrificing strength and durability of the block 300. The hollow center 340 also provides a place for the ends of the rope to be positioned while tied around the block. In various embodiments, the edges of the spools 310 are rounded. The rounded edges of the spools 310 decrease friction between the tow rope 240 and the block 300. By decreasing friction between the tow rope 240 and the block 300, the tow rope 240 experiences less friction or sharp edges. Less friction results in a reduced likelihood of fraying of the tow rope 240 and greater reliability.

The block 300 can be formed of a first spool 310*a* and a second spool 310*b* adjacent to the first spool 310*a*. A first arch 320*a* is coupled to the first spool 310*a* to form a first channel 330*a*. A second arch 320*b* is coupled to the second spool 310*b* to form the second channel 330*b*. A third arch 320*c* is couple to the first spool 310*a* to form the third channel 330*c*. A fourth arch 320*d* is coupled to the second spool 310*b* to form the fourth channel 330*d*. The first arch 320*a* and the third arch 320*c* are attached on opposite sides of the first spool 310*a*. The second arch 320*b* and the fourth arch 320*d* are attached on opposite sides of the second spool 310*b*.

The tow rope 240 may be used to tie any number of knots using the block 300 that are suitable to one of ordinary skill in the. In certain embodiments, a knot may be tied by threading a first end of the tow rope 240 through a first channel 330*a* and then through an adjacent second channel 330*b*, forming a first loop in the tow rope 240 extending outward from the ends of the first channel 330*a* and second channel 330*b* and leaving at least eight inches of tail along the first end of the tow rope 240. The first channel 330*a* and third channel 330*c* should be along the same groove or first spool 310*a* of the body of the block 300. A second end of the tow rope 240 is threaded through a third channel 330*c* and then through an adjacent fourth channel 330*d*, forming a second loop in the tow rope 240 extending outward from the ends of the third channel 330*c* and fourth channel 330*d* and leaving at least eight inches of tail along the second end of the tow rope 240. The second channel 330*b* and fourth channel 330*d* should be along the same groove or second spool 310*b* of the body 310 of the block 300. The first end of the tow rope 240 is threaded through the second loop and the second end of the tow rope 240 is threaded through the first loop. The first and second ends of the tow rope 240 are tightened to eliminate slack in the line, thereby retaining the tow rope 240 within the channels 330*a-d*. This embodiment should not be construed as limiting. Any knot suitable to one of ordinary skill in the art may be used to connect the tow rope 240 to the block 300 and provide enough strength to tow a disabled railcar 100.

The block 300 may be used repeatedly and is less likely to break than current solutions because it has no moving parts. For example, once the disabled railcar 100 has been towed to a siding, each knot may be untied, leaving the block 300 to be reused. There is minimal risk of breaking or otherwise damaging the block 300 in the towing process, which helps to extend the life of the block 300.

Although FIGS. 3A-3C illustrate a block 300, various changes may be made to FIGS. 3A-3C. For example, the components of the block 300 are for illustration only. Various components in FIGS. 3A-3C could be omitted, combined, or further subdivided and additional components could be added according to particular needs.

FIGS. 4A, 4B, 4C and 4D illustrate a block 400 and a process 405-407 for securing two ends 410 and 420 of a tow rope in accordance with various embodiments of the present disclosure. For example, block 400 may be used as block 300 described above in FIG. 3. The block is described by a top or first side 411, a bottom or opposite side 412, a front side 413 and a back side 414.

Block 400 contains four channels, channel 405, channel 406, channel 407, and channel 408. Channel 405 is a first channel located on the first side 411 of the block 400. Channel 406 is a second channel located adjacent to the first channel 405 on the first side 411 of the block 400. Channel 407 is a third channel located on an opposite side 412 of the block 400 from the first channel 405. Channel 408 is a fourth channel located adjacent to the third channel 407 on the opposite side 412 of the block from the second channel 406.

The four channels 405-408 are configured to be of a diameter to allow the tow rope 240 to pass through. In various embodiments, channels 405-408 are channels 330*a-d*. In various embodiments, the four channels 405-408 are created by four adjacent conduits. In these embodiments, the four adjacent conduits may form a square or any other suitable configuration. The block 400 may be fabricated in any one of a number of different ways. For example, in one embodiment channel 405, channel 406, channel 407, and channel 408 may each be a separate steel conduit, and may be welded or otherwise coupled together. In certain embodiments, the block 400 may be composed of either steel and/or aluminum, and may be cast or machined to define the conduits 405-408.

Figure 4B:
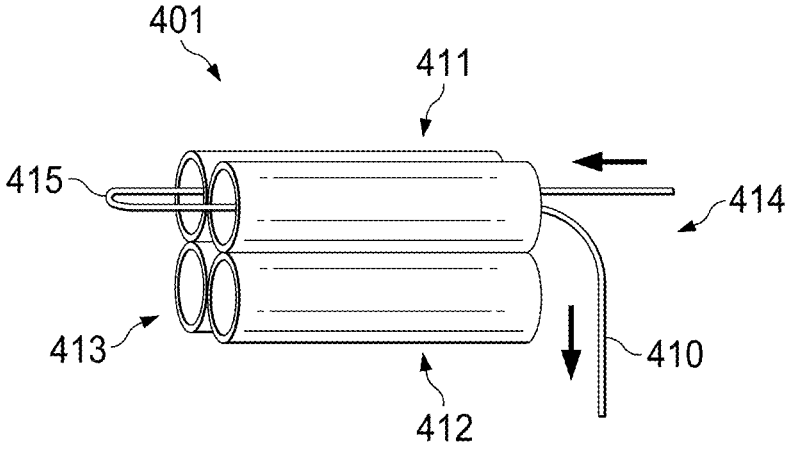
FIGS. 4B, 4C, and 4D illustrate a process for securing two ends of a tow rope using a block in accordance with various embodiments of the present disclosure.

In operation 401 illustrated in FIG. 4B, a first end 410 of the tow rope 240 is shown threaded through channel 405. After passing through channel 405, the first end 410 is then threaded back through channel 406. The first end 410 is left untied. By threading through channel 405 and then through channel 406, the first end 410 forms a first loop 415 on a front side 413 of the block 400. The first end 410 extends out of channel 406 on a back side 414 of the block 400.

Figure 4C:
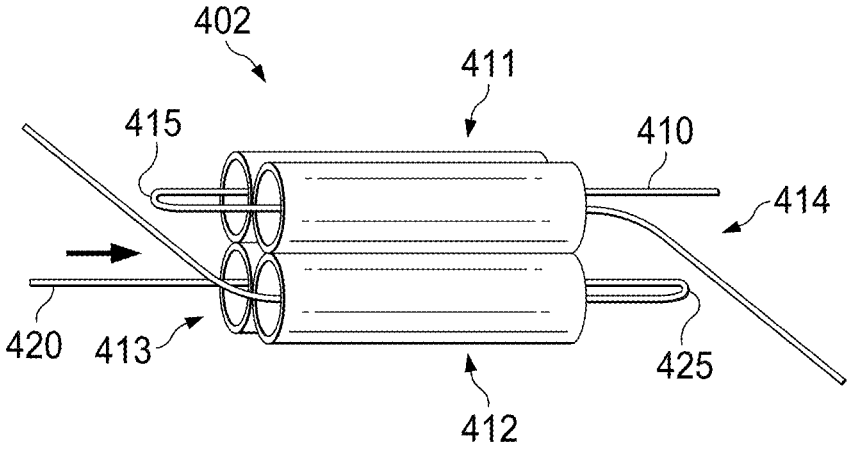

In operation 402 illustrated in FIG. 4C, the first end 410 and the first loop 415 are shown. A second end 420 of tow rope 240 is shown threaded through channel 407. After passing through channel 407, the second end 420 is then threaded back through channel 408. The second end 420 is left untied. By threading through channel 407 and then through channel 408, the second end 420 forms a second loop 425 on the back side 414 of the block 400. The second end 420 extends out of the channel 408 on the front side 413 of the block 400.

Figure 4D:
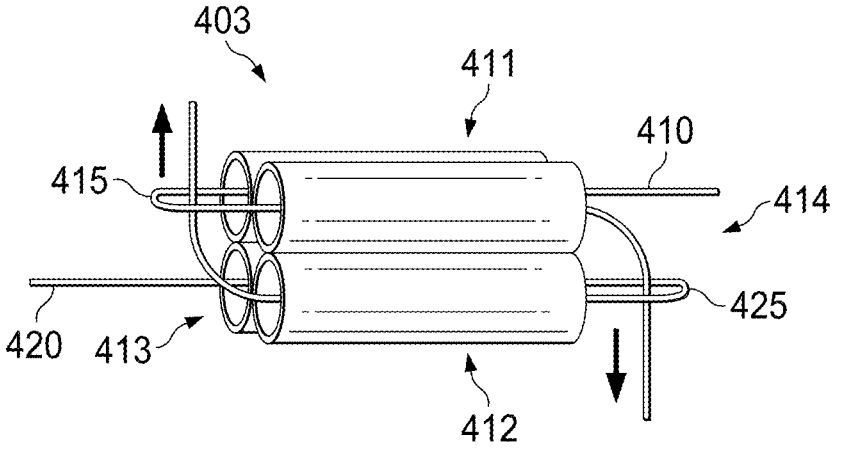

In operation 403 illustrated in FIG. 4D, the first end 410, the first loop 415, the second end 420, and the second end 425 are shown. The first end 410 is threaded through the second loop 425, and the second end 420 is threaded through the first loop 415. The first end 410 and the second end 420 are tightened, pulling the first loop 415 over the second end 420 and the second loop 425 over the first end 410. This forms a knot about the block 400.

In various embodiments, the block 400 has spacers between the channels 405-408, increasing the distance between the channels 405-408. Increasing the distance between the channels 405-408 decreases the angle of the tow rope 240 as the tow rope 240 is threaded through the channels 405-408. Decreasing the angle of the tow rope 240 between the channels 405-408 minimizes any potential damage to the tow rope 240. In various embodiments, the block 400 has rounded edges in the channels 405-408, which also serve to minimize potential damage to the tow rope 240. For example, sharp edges of the block 400 and/or channels 405-408 may fray the tow rope 240 over time. In various embodiments, a cast block 400 may produce edges that are more round than a block 400 than is welded. This embodiment decreases potential damage to the tow rope 240, for example fraying.

In various embodiments, the knot in FIG. 4D is tied on a block 400 on each side of two railcars 205. In these embodiments, the knots have a maximum tension force of the strap/ropes of 52,500 pounds of force, assuming the railcar 205 is a loaded coal car, on a 3% grade, accelerating to a speed of two miles per hour over twenty seconds, and calculating extra force to begin the railcar's 205 motion. Thus, each knot in FIG. 4D is capable of withstanding a maximum pull force of the tow rope 240 at 26,250 pounds per tow rope 240.

Figure 5:
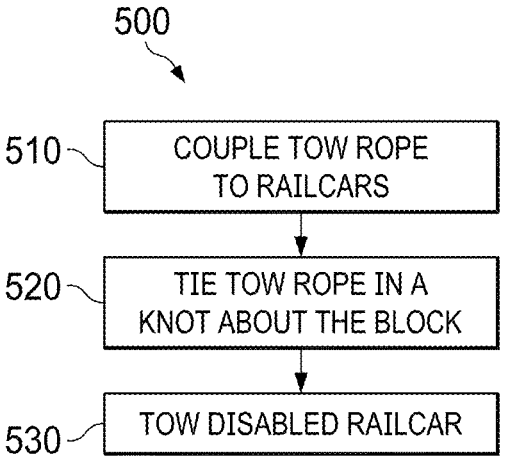
FIG. 5 illustrates an example process for towing railcars in accordance with various embodiments of the present disclosure.

FIG. 5 illustrates an example process 500 for towing railcars 205 in accordance with various embodiments of the present disclosure. For example, the process 500 could be performed using the block 300, railcars 205, and tow rope 240.

In operation 510, the tow rope 240 couples to the railcars 205. A separate end of the tow rope 240 couples to each end of the railcars 205. For example, a first end of the tow rope 240 threads through the slots 225 in the side frame 230 of railcar 205*a*. The second end of the tow rope 240 threads through the slots 225 in the side frame 230 of railcar 205*b*. In various embodiments, measures may be taken to protect some or all of the tow rope 240. For example, the portions of the tow rope 240 that are inserted through the slots 225 of the side frame 230 may be covered by a protective sleeve. In certain embodiments, operation 510 is performed on both sides of the railcars 205, with one tow rope 240 coupled to one side of railcars 205 and another tow rope 240 coupled to the other side of railcars 205. In this embodiment, the railcars 205 are connected by two tow ropes 240.

In operation 520, the tow rope 240 ties in a knot about the block 300. The knot brings together the two ends of the tow rope 240 and provides strength and tension for towing. In certain embodiments, the knot may be tied by threading the first end of the tow rope 240 through a first channel 330*a* and then through an adjacent second channel 330*b*, forming a first loop in the tow rope 240 extending outward from the ends of the first 330*a* and second channels 330*b* and leaving at least eight inches of tail along the first end of the tow rope 240. The first 330*a* and second channels 330*b* are along the same groove of the body 310 of the block 300. A second end of the tow rope 240 threads through a third channel 330*c* and then through an adjacent fourth channel 330*d*, forming a second loop in the tow rope 240 extending outward from the ends of the third 330*c* and fourth channels 330*d* and leaving at least eight inches of tail along the second end of the tow rope 240. The third 330*c* and fourth channels 330*d* are along the same groove of the body 310 of the block 300. The first end of the tow rope 240 threads through the second loop and the second end of the tow rope 240 threads through the first loop. The first and second ends of the tow rope 240 tighten to eliminate slack in the line, thereby retaining the tow rope 240 within the channels 330*a-d*.

In certain embodiments, operation 520 is performed on both sides of the railcars 205, with each tow rope 240 coupled to the railcars in operation 510 tying a knot about a block 300. In this embodiment, the railcars 205 are connected by two tow ropes 240 and two blocks 300. In certain embodiments, the two tow ropes 240 are of equal lengths when operation 520 is complete. Making the tow ropes 240 an equal length when tied in a knot about the block 300 allows the tow ropes 240 to be of an equal tension when towing the second railcar 205*b*, decreasing the chance of derailment.

In operation 530, the second railcar 205*b* is towed using the first railcar 205*a*. As the first railcar 205*a* travels along the railroad track, the second railcar 205*b* travels behind it, pulled by the tension in the two tow ropes 240. In certain embodiments, the second railcar 205*b* is towed to a siding. In various embodiments, once the second railcar 205*b* has been successfully towed, the knots are untied and the tow ropes 240 are removed from the railcars 205. Although FIG. 5 illustrates one example of a process 500 for towing railcars 205, various changes may be made to FIG. 5. For example, although depicted herein as a series of steps, the steps of the process could overlap, occur in parallel, occur in a different order, or occur multiple times.

The description in this patent document should not be read as implying that any particular element, step, or function is an essential or critical element that must be included in the claim scope. Also, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim is understood and intended to refer to structures known to those skilled in the relevant art, as further modified or enhanced by the features of the claims themselves, and is not intended to invoke 35 U.S.C. § 112(f).

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method of towing railcars comprising:

threading a first end of a tow rope from a first side frame of a first railcar through a first channel located on a first side of a block;

threading the first end of the tow rope from a second side frame of a second railcar through a second channel forming a first loop in the tow rope, the first loop extending outward from the first channel and the second channels on a front side of the block, wherein the second channel is located adjacent to the first channel on the first side of the block;

extending the first end out of the second channel on a back side of the block;

threading a second end of the tow rope through a third channel located on an opposite side of the block from the first channel;

threading the second end of the tow rope through a fourth channel forming a second loop in the tow rope, the second loop extending outward from the third and fourth channels on the back side of the block, wherein the fourth channel is located adjacent to the third channel on the opposite side of the block from the second channel;

extending the second end out of the second channel on the front side of the block.

2. The method of claim 1, wherein:

the first end is threaded through the second loop; and the second end is threaded through the first loop.

3. The method of claim 2, wherein:

when the first end is threaded through the first channel, a first arch lines up with a first marking on the first end; and when the second end is threaded through the third channel, a third arch lines up with a first marking on the second end.

4. The method of claim 3, wherein the first marking on the first end and the second marking on the second end indicate an amount of the tow rope to tie a knot on the block using the tow rope.

5. The apparatus of claim 1, wherein the body includes a first spool including the first channel and third channel, and a second spool adjacent to the first spool and including the second channel and fourth channel.

6. The apparatus of claim 5, wherein a first arch is coupled to the first spool to form the first channel, a second arch is coupled to the first spool to form the second channel, a third arch is coupled to the second spool to form the third channel, and a fourth arch is coupled to the second spool to form the fourth channel.

7. A tow rope system, comprising:

a tow rope comprising:

a first end wrapped around a first side frame of a first railcar, and a second end wrapped around a second side frame of a second railcar, and a block having said tow rope therethrough structured with:

a first channel located on a first side of the block;

a second channel located adjacent to the first channel on the first side of the block;

a third channel located on an opposite side of the block from the first channel; and a fourth channel located adjacent to the third channel on the opposite side of the block from the second channel.

8. The system of claim 7, wherein:

a first end of a tow rope is threaded through the first channel and threaded back through the second channel forming a first loop in the tow rope extending outward from the first channel and the second channel on a front side of the block, the first end extending out of the second channel on a back side of the block; and a second end of the tow rope is threaded through the third channel and threaded back through the fourth channel forming a second loop in the tow rope extending outward from the third and fourth channels on the back side of the block, the second end extending out of the fourth channel on the front side of the block.

9. The system of claim 8, wherein:

the first end is threaded through the second loop; and the second end is threaded through the first loop.

10. The system of claim 9, wherein:

when the first end is threaded through the first channel, a first arch lines up with a first marking on the first end; and when the second end is threaded through the third channel, a third arch lines up with a second marking on the second end.

11. The system of claim 10, wherein the first marking on the first end and the second marking on the second end indicate an amount of the tow rope to tie a knot on the block using the tow rope.

12. The system of claim 7, further comprising:

a first spool including the first channel and third channel; and a second spool adjacent to the first spool and including the second channel and fourth channel.

13. The system of claim 12, wherein:

a first arch is coupled to the first spool to form the first channel, a second arch is coupled to the second spool to form the second channel, a third arch is coupled to the first spool to form the third channel, and a fourth arch is coupled to the second spool to form the fourth channel.

* * * * *